US007509906B2

(12) United States Patent
Wu et al.

(10) Patent No.: US 7,509,906 B2
(45) Date of Patent: Mar. 31, 2009

(54) MICROFLUIDIC DRIVING AND SPEED CONTROLLING APPARATUS AND APPLICATION THEREOF

(75) Inventors: Bi Chu Wu, Hsinchu County (TW); Gin Shu Young, Hsinchu County (TW); Chung Kai Chen, Hsinchu County (TW); Yu Ching Liu, Hsinchu County (TW); Su Jan Lee, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 328 days.

(21) Appl. No.: 11/319,631

(22) Filed: Dec. 29, 2005

(65) Prior Publication Data

US 2006/0159564 A1 Jul. 20, 2006

(30) Foreign Application Priority Data

Dec. 31, 2004 (TW) ..... 93141598 A

(51) Int. Cl.
*F01B 29/00* (2006.01)
*F15B 15/26* (2006.01)

(52) U.S. Cl. ..... 92/143; 92/19; 92/163

(58) Field of Classification Search ..... 92/18, 92/19, 23, 30, 143, 163
See application file for complete search history.

(56) References Cited

U.S. PATENT DOCUMENTS 5,979,163 A * 11/1999 Hanners et al. ..... 92/143
6,213,151 B1 * 4/2001 Jacobson et al. ..... 137/827
2002/0166582 A1 * 11/2002 O'Connor et al. ..... 137/15.18

* cited by examiner

*Primary Examiner*—Michael Leslie
(74) *Attorney, Agent, or Firm*—Bacon & Thomas, PLLC

(57) ABSTRACT

The present invention provides an off-chip apparatus and a method for driving micro fluid wherein one or a plurality of impedance members, plunger positioning members and pressure difference design are used to drive the fluid and control the flow speed in a microfluidic system. The present invention also provides a method for driving fluid and controlling flow speed, wherein a slow pressure balancing mechanism is produced by the foregoing device so the flow speed of fluid can be controlled.

24 Claims, 10 Drawing Sheets

MICROFLUIDIC DRIVING AND SPEED CONTROLLING APPARATUS AND APPLICATION THEREOF

BACKGROUND OF THE INVENTION

1. Field of the Invention

The present invention relates to an off-chip apparatus and a method for driving continuously and controlling the flow speed of fluid in a microfluidic chip. It is applicable to the field of microfluidic technology.

2. Description of Related Art

In recent years the development of microfluidic chips has earned a lot of attention due to the ability to integrate electronic, chemical and biomedical technologies to the chip. Microfluidic chips are also applicable to a wide range of fields such as pharmaceutical research, genetic engineering, gene expression, sequencing, protein assays, environment monitoring and clinical diagnosis. Advantages associated with microfluidic chips include the reduction of experimental error from inaccuracies in operation, the enhancement of system stability, the reduction of sample volume required, and the saving of time and labor.

The operation of a microfluidic chip often requires an active driving apparatus to move the fluid in the chip at a flow speed within a specified range. In the design of the driving apparatus, some features for microfluidic applications must be considered:

1. The amount of the fluid to be handled is very small, often at the nano- or micro-liter level. Therefore, the active driving apparatus must move the fluid with small positive or negative pressure.
2. The flow speed of the fluid driven must be controlled within a specified range. If the flow speed of the fluid is too fast or too slow, the microfluidic chip may not perform its function properly. In a bioassay chip, for example, if the fluid is driven too fast, the analyte in the fluid may leave the reaction zone before the necessary reactions are completed. Therefore, in addition to the need for low driving pressure, the apparatus must also provide design variables that may be customized to vary flow speed as needed for different applications.
3. The apparatus must provide a sufficient driving duration in whole process when moving the fluid. Again consider the bioassay chip example. The driving apparatus must continuously move the liquid sample at a flow speed within a specified range during the whole process to complete the necessary reaction on the chip. Often a bioassay may take seconds to minutes for completion.
4. Product cost. Microfluidic chips have a wide range of applications. Because, in bioassay, the parts are often disposable, they must be inexpensive.

Technologies used to drive the fluid on a chip are often divided into two categories. One is an off-chip independent pump, often larger than the chip and attached to it. The other is an on-chip micro driving mechanism. The off-chip independent pump can be one of several types: diaphragm, bellows, centrifugal, drum, flexible impeller, gear, hose, peristaltic pump or syringe pump. When the volume of the liquid to be driven is small, a syringe pump or peristaltic pump may be applicable. Although both pumps meet the requirements of driving fluid in a microfluidic chip, they may be expensive.

There are many types of on-chip micro pumps: bubble pumps, membrane pumps, diffuser pumps, rotary pumps, electrohydrodynamic pumps, electrophoretic pumps or ultrasonic pumps. Although on-chip micro pumps may meet the requirements for liquid volume, flow speed control and driving duration, one major disadvantage is that they often limit the choice of the material used for the microfluidic chip. Most on-chip micro pumps use silicon as a substrate, which requires photolithography as part of the manufacturing process. In many cases, additional parts, such as electrodes made from metal layers, magnetic coils made from special metals, or activating devices made from piezoelectric materials, are needed to make an on-chip micro pump. Such parts limit the choices of chip materials and increase the manufacturing cost of the product. In addition, the complexity of the manufacturing process of such parts leads to challenges in reproducibility of product quality.

In U.S. Pat. No. 6,802,228 an electro-mechanical device, a complicated mechanism, is used to control the syringe pump and drive the fluid. In U.S. Pat. Nos. 6,418,968, 6,748,978 a porous layer embedded in the chip as a valve to control the flow of the fluid limits the choice of material for the chip. In US Application No. 2002/0072719 the design requires collecting body fluid in a syringe. In U.S. Pat. No. 5,944,698 a syringe is designed to release liquid one drop at a time. Because the syringe must be filled with liquid before use, it may not be very convenient for certain microfluidic applications.

Therefore, the following features are desirable in an off-chip fluid driving apparatus: a mechanism based on a simple design, the ability to drive small quantities of liquid, flow speed within a specified range, sufficient driving duration, low manufacturing cost and simplicity in driving operation.

SUMMARY OF THE INVENTION

In view of the shortcomings of previously designed apparatuses, one objective of the present invention is to provide a microfluidic driving apparatus for driving fluids and controlling flow speed in a microfluidic system. The apparatus comprises: a syringe, which comprises a barrel and a plunger, wherein the barrel is provided with an opening, and the plunger is capable of moving in the barrel; a plunger positioning member, which is mounted at the inside or outside of the barrel and is capable of holding the plunger in a preset position; a connecting unit for connecting the syringe and the microfluidic system; and an impedance member, which is mounted inside the barrel, the microfluidic system or the connecting unit; wherein a pressure difference between the barrel and the microfluidic system is created to drive the fluid flowing inside the microfluidic system by relocating the plunger in the barrel to a preset position, and the fluid is regulated at a lower speed by using the impedance member.

Another objective of the present invention is to provide a method for driving the fluid flowing in a microfluidic system comprising the following steps: connecting the microfluidic driving apparatus to a microfluidic system mentioned above; moving the plunger to a preset position to induce a pressure difference between the barrel and the microfluidic system and drive the fluid flowing in the microfluidic system; and using an impedance member to obstruct the pressure balancing process, allowing the fluid inside the microfluidic system to flow at a regulated speed.

Another objective of the present invention is to provide a microfluidic driving apparatus for driving the fluid flowing in a microfluidic system, comprising a syringe and an impedance member. The syringe comprising a barrel and a plunger is connected to the microfluidic system. The plunger is capable of moving in the barrel. The impedance member can be mounted inside the barrel, inside the microfluidic system or between the barrel and the microfluidic system. Moving the plunger in the barrel creates a pressure difference between the barrel and the microfluidic system to drive the fluid flowing inside the microfluidic system. The fluid is regulated at a lower flow speed by the impedance member.

Another objective of the present invention is to provide a microfluidic driving apparatus for driving a fluid flowing in a microfluidic system, and the apparatus comprises: a barrel, which is connected to said microfluidic system, wherein the barrel comprises a plunger capable of moving in the barrel along an axis of the barrel; and an impedance member, which is mounted inside the barrel, inside the microfluidic system or between the barrel and the microfluidic system; wherein a pressure difference between the barrel and the microfluidic system is created to drive the fluid flowing inside the microfluidic system by moving the plunger in the barrel, and the fluid flowing inside the microfluidic system is regulated at a lower speed by using the impedance member.

Other objectives, advantages, and innovative features of the invention will become apparent from the following detailed description and the accompanying drawings.

DETAILED DESCRIPTION OF THE PREFERRED EMBODIMENT

Figure 1:
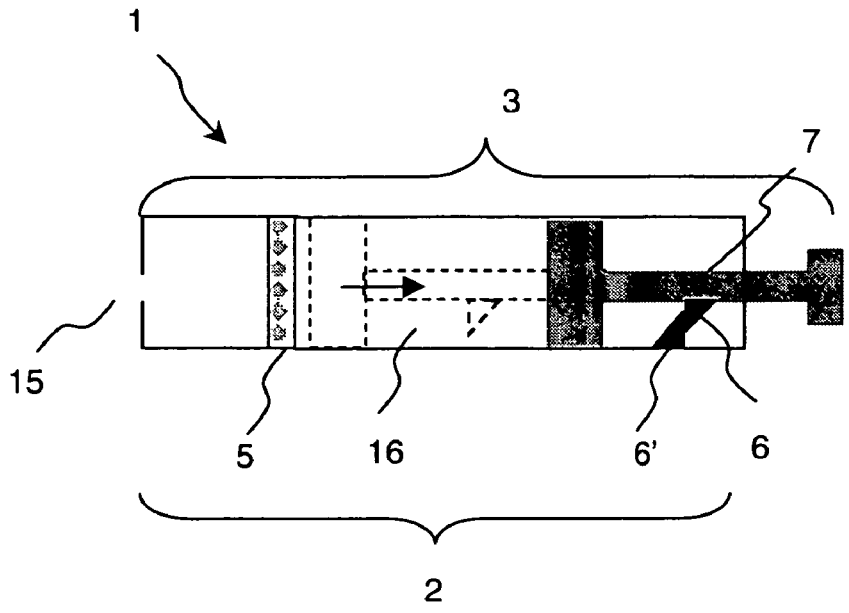
FIG. 1: a microfluidic driving and speed controlling apparatus of the present invention provided with a plunger positioning member mounted inside the barrel.
Figure 2:
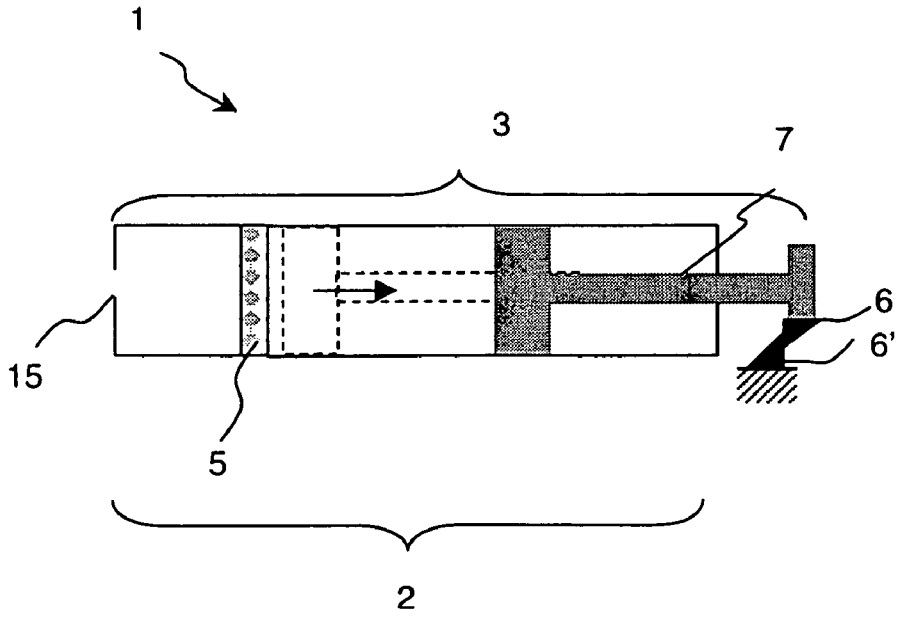
FIG. 2: a microfluidic driving and speed controlling driving apparatus of the present invention provided with a plunger positioning member mounted outside the barrel.

In one embodiment of the present invention, the microfluidic driving and speed controlling device is an off-chip apparatus attached to the chip. By exerting suction or expelling force, the apparatus controls the movement of the fluid in the channel of the microfluidic region of the chip at a flow speed within a proper range. As shown in FIG. 1, the microfluidic driving and speed control apparatus 1 of the present invention includes: a syringe 3 with a barrel 2 and a plunger 7, the barrel 2 provided with an opening 15, and the plunger 7 capable of moving in the barrel 2; a plunger positioning member 6, mounted either inside (as shown in FIG. 1) or outside (as shown in FIG. 2) the barrel and capable of holding the plunger in a preset position; a connecting unit connecting syringe 3 and microfluidic system; and an impedance member 5 mounted inside either the barrel, the microfluidic system, or the connecting unit. When the plunger 7 moves to a preset position a pressure difference is created between the barrel and the microfluidic system capable of driving the fluid in the microfluidic system. The impedance member 5 obstructs the process of pressure balance so the fluid inside the microfluidic system can be regulated at a lower flow speed.

Figure 3:
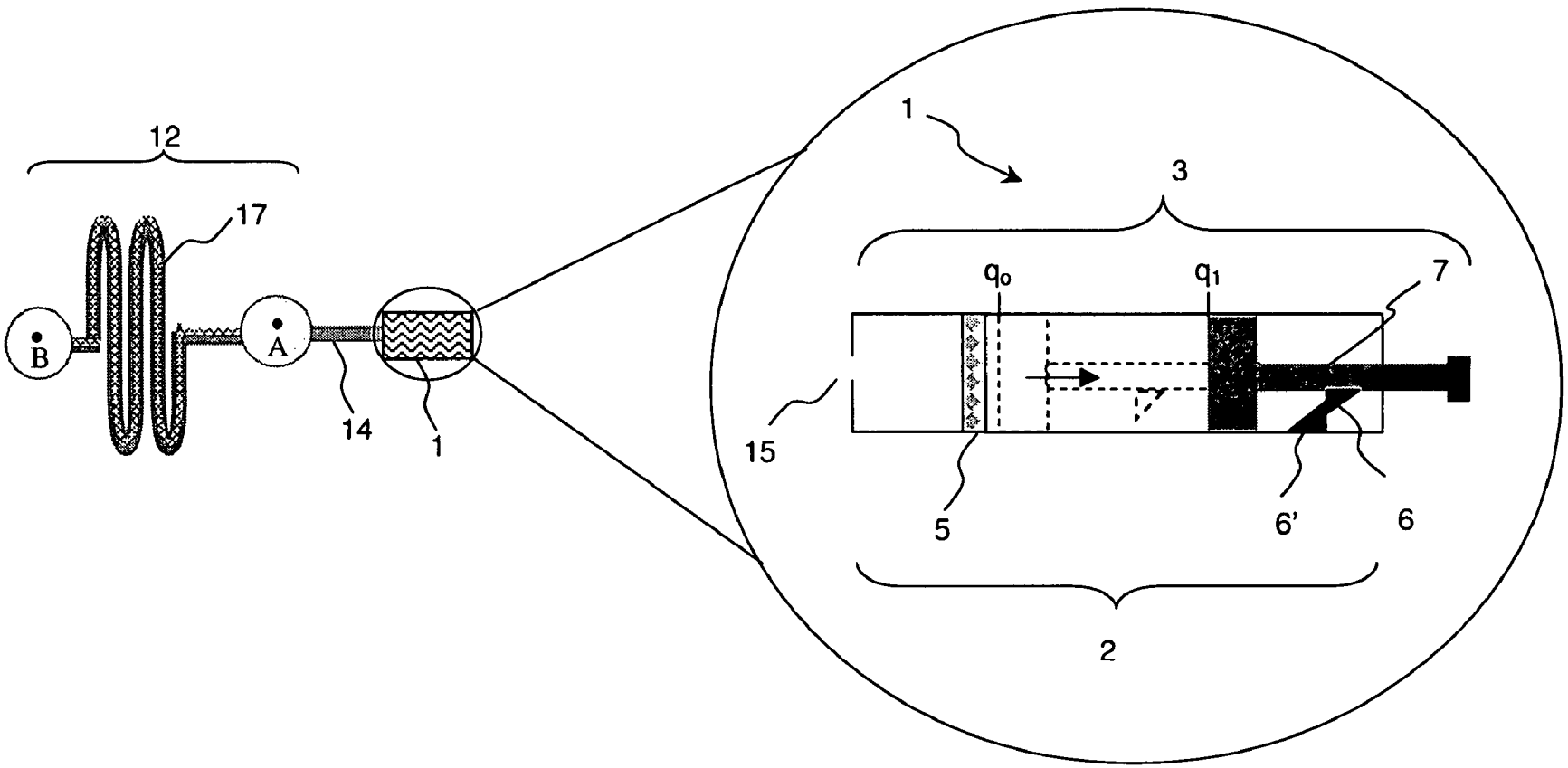
FIG. 3: a suction type fluid driving apparatus of the present invention.

FIG. 3 depicts the schematic diagram of the apparatus 1 of the present invention linked to the microfluidic system 12 by a connecting unit 14 which may be a connecting tube. The junction of the microfluidic system 12 and the connecting unit 14 of the apparatus 1 can, but may not necessarily; be a reservoir or a microfluidic channel in the microfluidic system 12. The junction of the connecting unit 14 and the microfluidic system 12 may also be designed at the inside of the microfluidic system 12. The connecting unit 14 of the apparatus 1 can be a one-to-one path or one-to-more-than-one branches, that is, one syringe connected to a channel of the microfluidic system, or one syringe connected to a number of branches of the microfluidic system.

The apparatus of the present invention may work as a stand-alone instrument or be designed and integrated as part of a microfluidic system.

FIG. 3 shows an example of an embodiment of the present invention in which suction is applied to drive the liquid in the microfluidic system from position B toward position A. The plunger 7 of the driving apparatus 1 is pulled from position q0 to position q1 and held on position q1 by the docking of the matching parts of the plunger positioning members 6 and 6'. Because of the relocation of the plunger 7 in the syringe 3 the volume at the front of the plunger 2 is increased and a pressure difference is created between the barrel and the microfluidic system. The pressure difference drives the liquid in the microfluidic system from position B toward position A until the pressures of the two sides of the impedance member balance.

Figure 4:
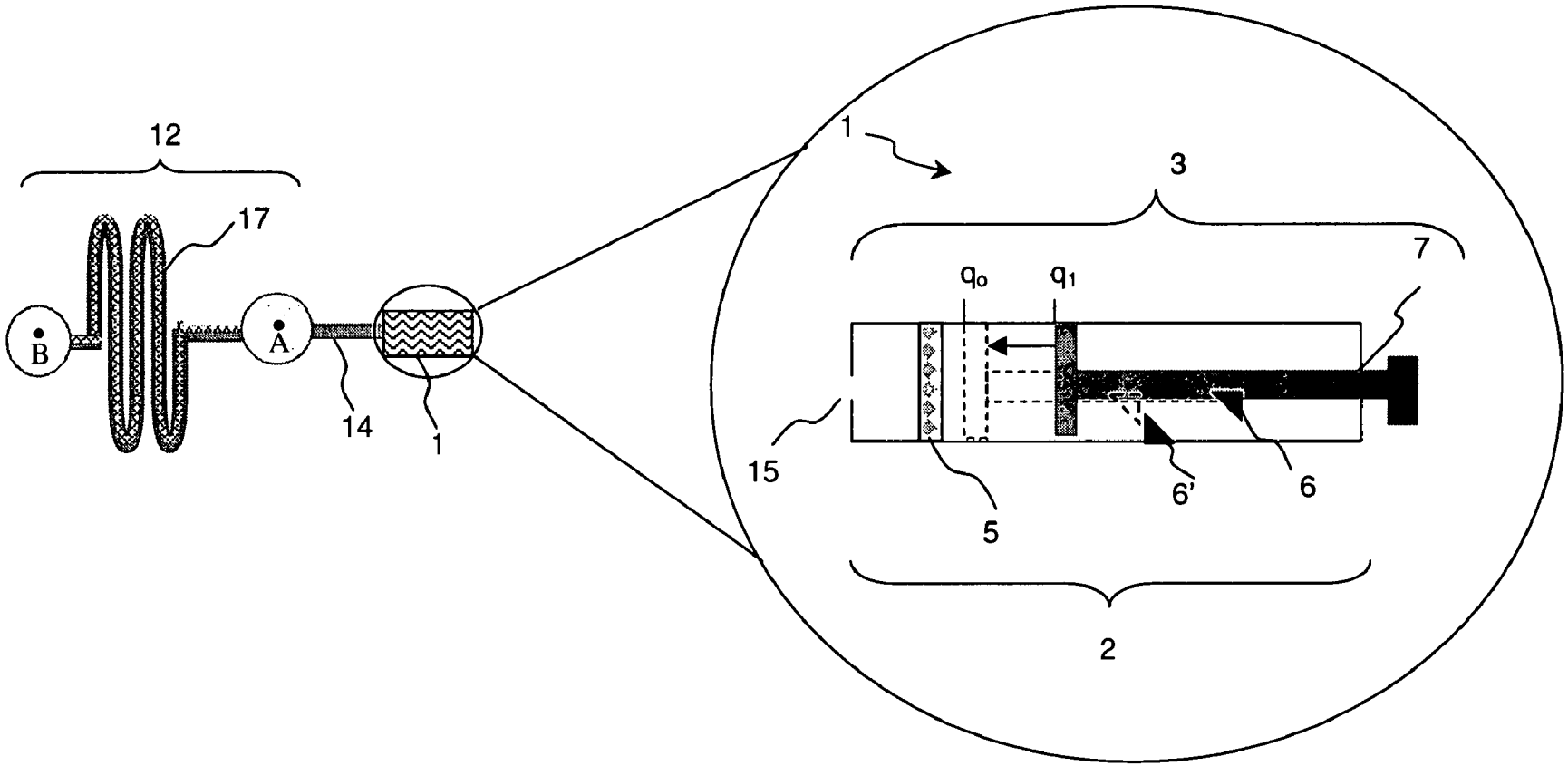
FIG. 4: an expelling type fluid driving apparatus of the present invention.

FIG. 4 shows an example of another embodiment of the present invention in which an expelling force is generated to move the liquid in the microfluidic system from position A toward position B. The plunger 7 of the driving apparatus 1 is pushed from position q1 to position q0 and held on position q0 by the docking of the matching parts of the plunger positioning members 6 and 6'. Because of the relocation of the plunger 7, the volume at the front of the plunger 2 is decreased creating a pressure difference between the barrel and the microfluidic system. The pressure difference drives the liquid in the microfluidic system from position A toward position B until the pressures of the two sides of the impedance member 5 balance.

The inside diameter of the barrel 2 can be customized to meet the requirements of practical applications. In one embodiment of the present invention, the barrel 2 comprises a uniform inside diameter (as shown in FIGS. 1 to 4). In another embodiment of the present invention, the barrel 2 comprises a non-uniform inside diameter.

Figure 5:
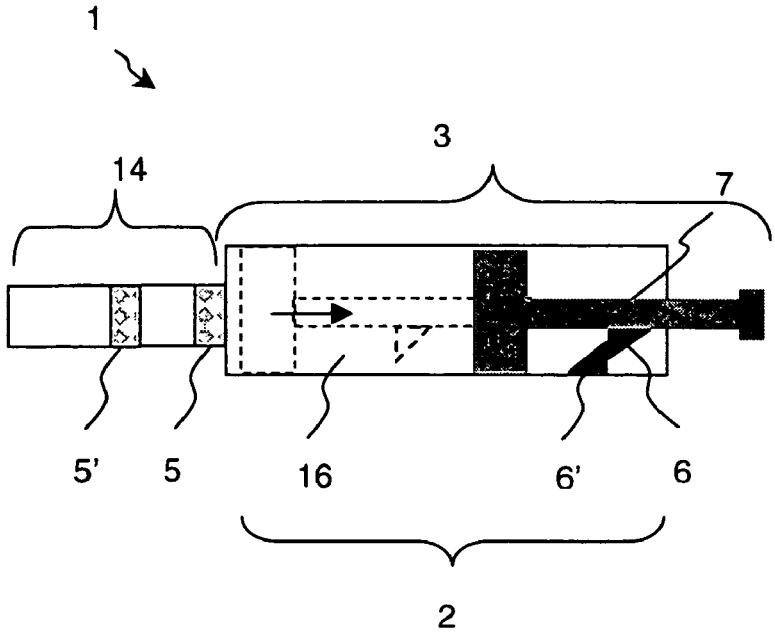
FIG. 5: a fluid driving apparatus provided with impedance members in a two-stage design.

Furthermore, the driving apparatus 1 can be designed as a multi-stage liquid driving system. For example, a secondary impedance member 5' can be used to enhance the impedance effect and further reduce the flow speed of the fluid, as shown in FIG. 5. Note: the present invention is not limited to the above-mentioned two-stage impedance design. More than two impedance members may be used to generate a multi-stage impedance effect if necessary.

Figure 6:
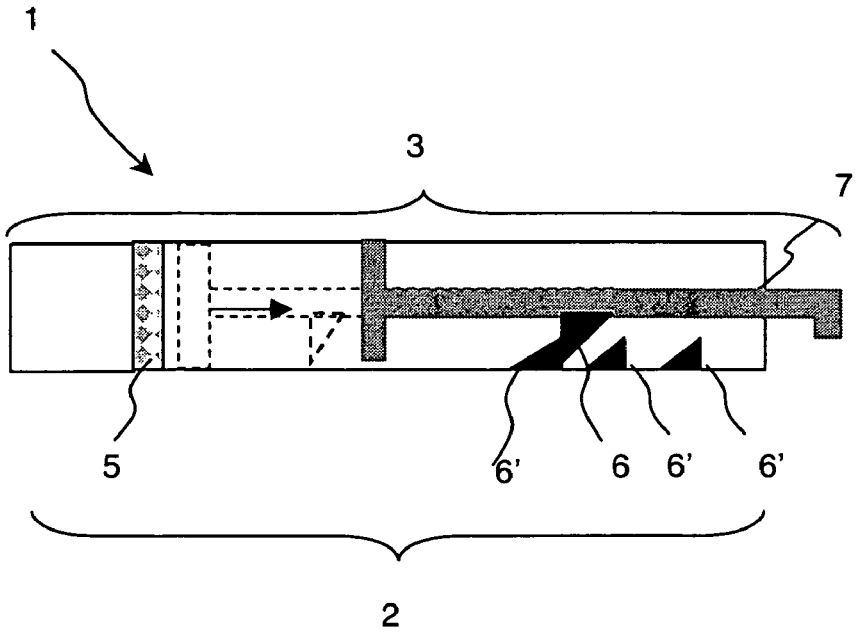
FIG. 6: a microfluidic driving and speed controlling apparatus of the present invention provided with a plurality of plunger positioning members.

On the other hand, the driving apparatus 1 may also comprise a plurality of plunger positioning members 6', as shown in FIG. 6. Once the plunger 7 is relocated to a preset position and remains there for a period of time, it can be relocated to yet another preset position, and so on, to achieve multi-stage fluid control.

By altering the design parameters the flow speed of the liquid can be controlled to meet the requirements of various applications. Design parameters may include the porosity of the impedance member 5, the number of impedance members 5, the number and locations of plunger positioning members, or the volume of the space in front of the plunger 7 inside the barrel 2, etc.

The plunger 7 of the apparatus 1 can be driven inside the barrel manually, mechanically or electrically.

In one embodiment of the present invention, the plunger 7 moves inside the barrel by a sliding motion, and the matching parts of the plunger positioning members 6 and 6' may be, for example, wedge-shaped stoppers as shown in FIGS. 1 to 6. Because of the resilience of the positioning members, the plunger can be moved to the preset position and be held there.

Figure 7:
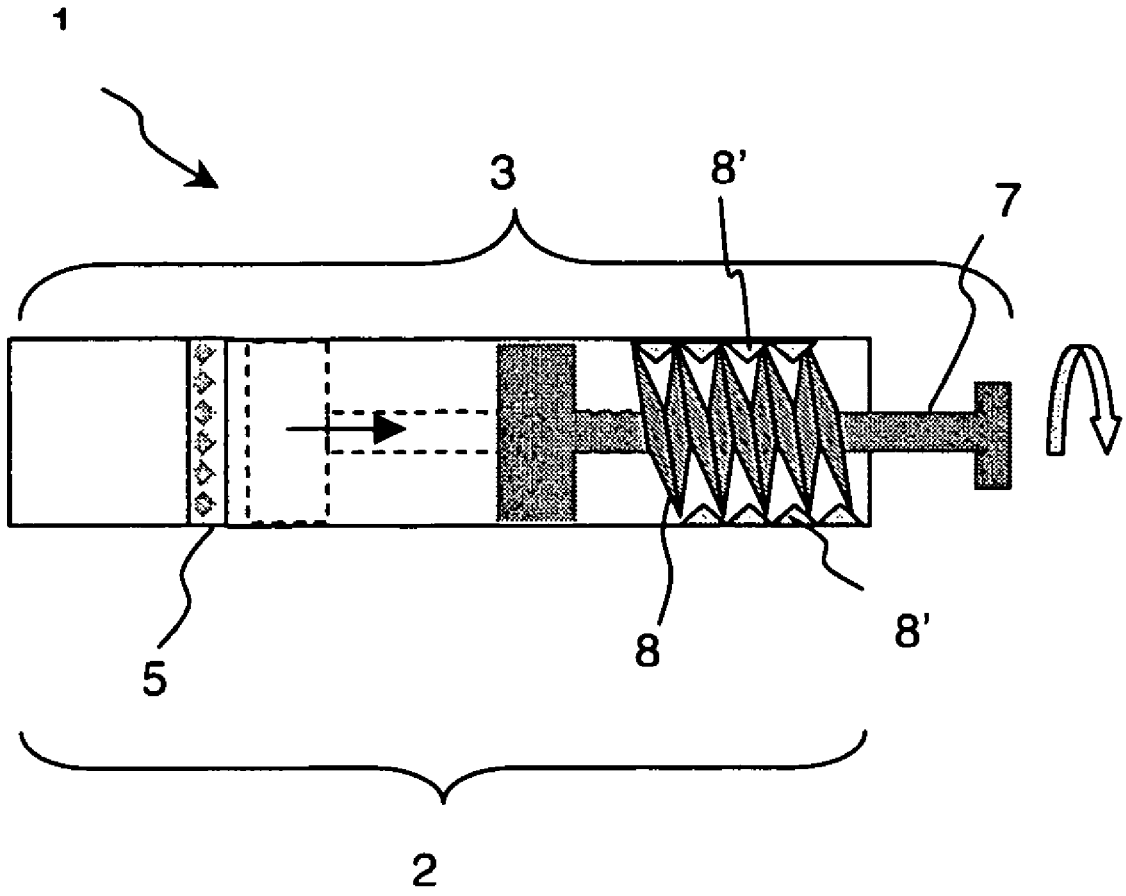
FIG. 7: the plunger of the microfluidic driving and speed controlling apparatus of the present invention moving within the barrel in a spiral motion.

In another embodiment of the present invention, the plunger positioning member prevents unwanted movement of the plunger from the preset position by friction resistance. In another embodiment of the present invention, the plunger 7 moves inside the syringe 3 in a spiral motion, and the plunger positioning member, formed by a set of bolts 8 and nut pattern structures 8', for example, holds the plunger at the preset position as shown in FIG. 7.

The impedance member 5 of the microfluidic driving apparatus 1 can be mounted, for example, inside the barrel of the apparatus (as shown in FIG. 3), in the microfluidic system, or in the connecting unit (as shown in FIG. 5).

The impedance member may be a single orifice member or a porous member. The material, for example, may be, but is not limited to: polyurethane, nitrocellulose, polyethylene, polycarbonate, polytetrafluoroethylene, polypropylene, polyvinylidene fluoride, polyamide, cellulose-esters, polysulfone, polyether-imide, polyetheretherketone. The impedance member may also be a small cross-section orifice structure.

The apparatus of the present invention can also work with other flow speed control mechanisms. For example, to improve the flow speed within the microfluidic system, geometric variations of the structure of the microfluidic channels may be used, a variety of channel materials may be used, or the channel surface may be modified using a hydrophilic and/or hydrophobic substance.

Figure 12:
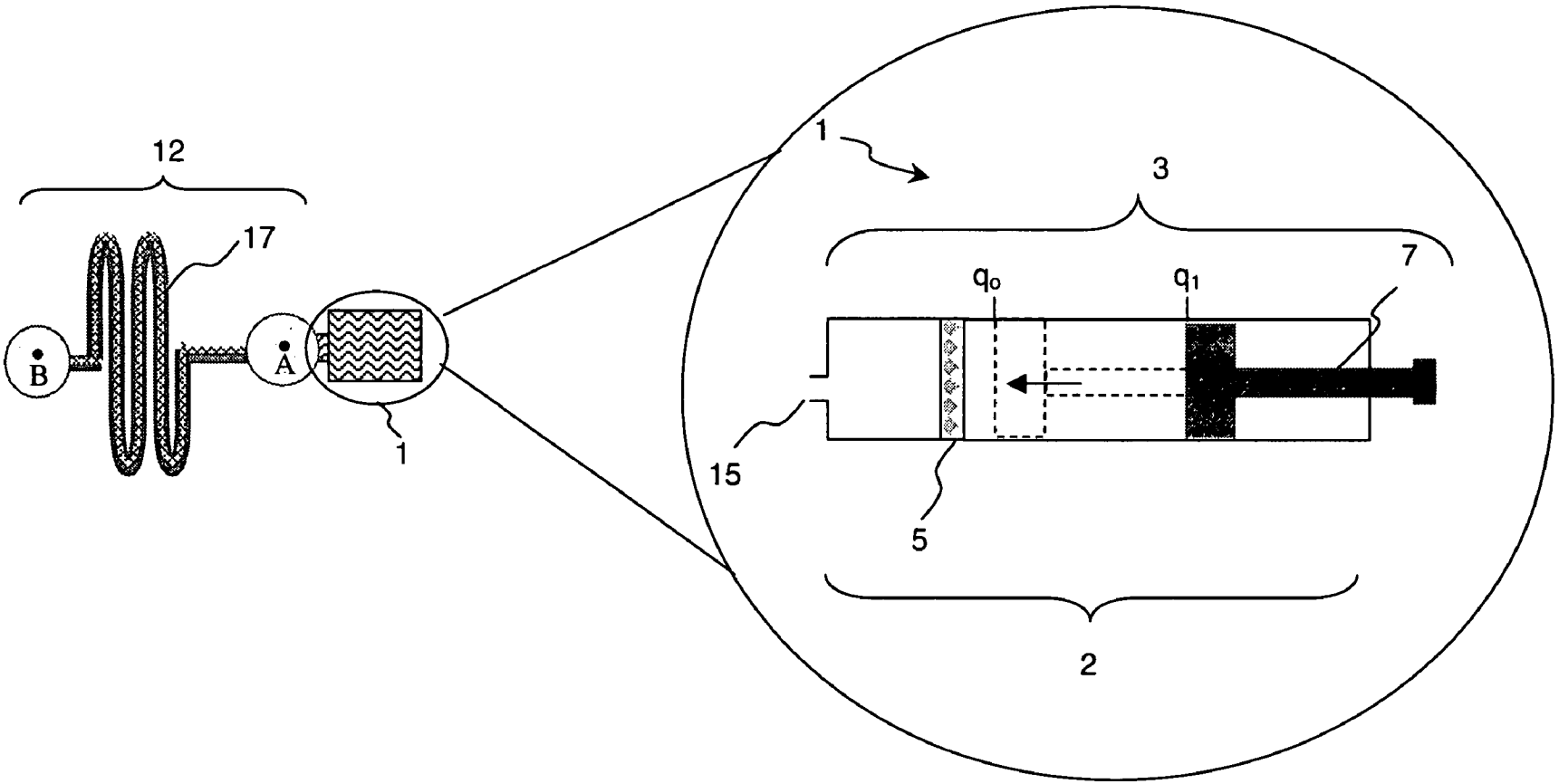
FIG. 12: another embodiment of the present invention.

Another example of the present invention is shown in FIG. 12. The microfluidic driving apparatus for driving fluid in a microfluidic system comprises a syringe and an impedance member. The syringe, connected to the microfluidic system, comprises a barrel and a plunger capable of moving in the barrel. The impedance member can be mounted inside the barrel, inside the microfluidic system, or between the barrel and the microfluidic system. Moving the plunger in the barrel creates a pressure difference between the barrel and the microfluidic system to drive the fluid inside the microfluidic system. The use of the impedance member regulates the flow at a lower speed. In another example of the present invention, a microfluidic driving apparatus for driving fluid in a microfluidic system comprises a barrel and an impedance member. The barrel, connected to the microfluidic system, comprises a plunger capable of moving along an axis in the barrel. The impedance member may be mounted inside the barrel, inside the microfluidic system, or between the barrel and the microfluidic system. Moving the plunger in the barrel creates a pressure difference between the barrel and the microfluidic system to drive the fluid in the microfluidic system. The use of the impedance member regulates the flow at a lower speed.

Other objectives, advantages, and innovative features of the invention will become apparent from the following examples that further demonstrate the advantages of the present invention and extend rather than limit its scope.

EXAMPLES

Example 1

Experiment 1 of the Microfluidic Driving Apparatus

Figure 8A:
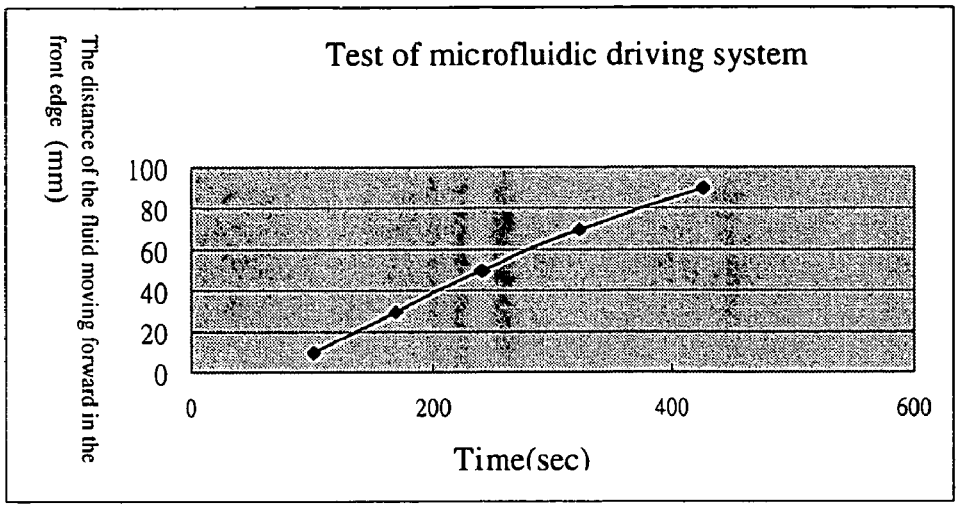
FIG. 8A: the experimental results of time vs. liquid driving distance presented in example 1.
Figure 8B:
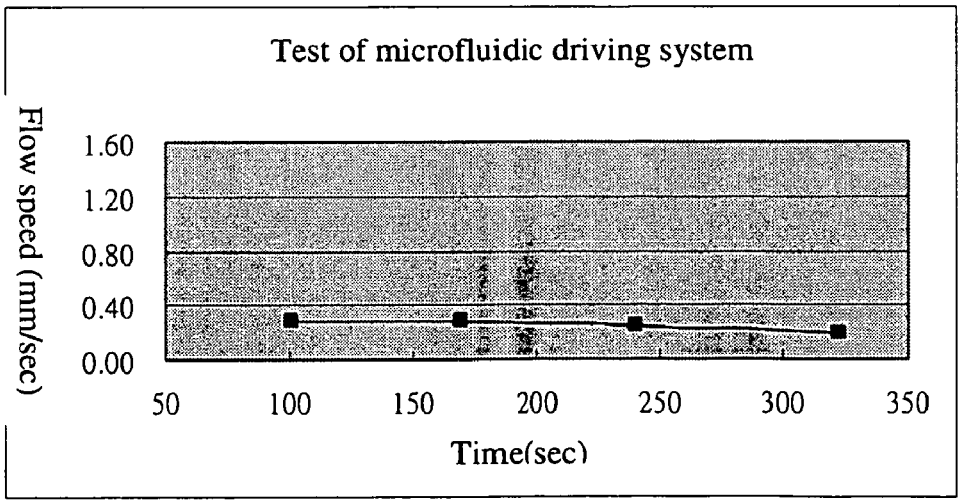
FIG. 8B: the experimental results of time vs. liquid flow speed presented in example 1.

In this example the ability of the fluid driving and flow speed control apparatus of the present invention was tested. As shown in FIG. 5, the apparatus was provided with a two-stage flow speed reduction mechanism. The material used for the two impedance members was polyurethane foam. The microfluidic channel was a silicone tube with a 1 mm inside diameter. The fluid driven in the channel was ink. In the experiment, the distance the fluid segment traveled was recorded and converted into the flow speed of the fluid, as shown in FIGS. 8A and 8B. Within the 7 minutes of observation, the flow speed was between 0.19~0.29 mm/sec, with an average of 0.25 mm/sec. The driving time interval can be adjusted to be longer or shorter to meet the requirements of specific applications. The flow speed can also be customized as needed. The results of this example show that the apparatus of the present invention is capable of driving fluid continuously in a channel at a stable flow speed.

Example 2

Experiment 2 of a Microfluidic Driving Apparatus

Figure 9A:
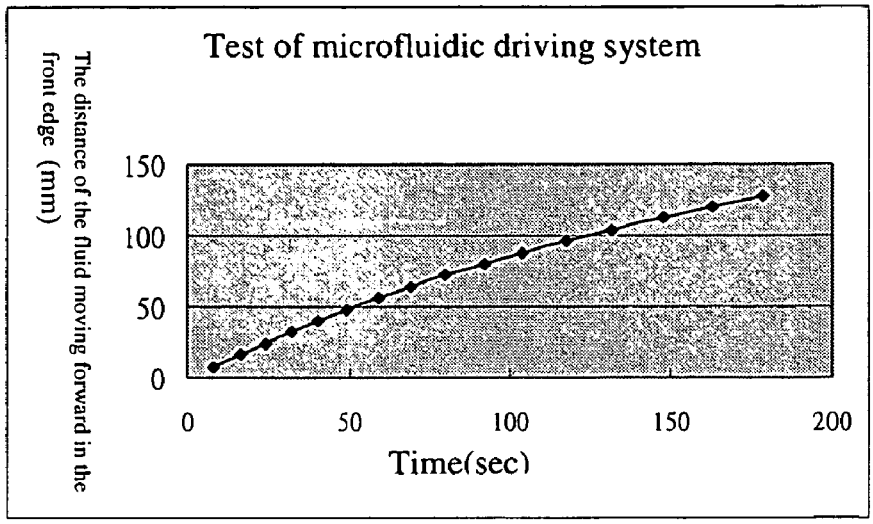
FIG. 9A: the experimental results of time vs. liquid driving distance presented in example 2.
Figure 9B:
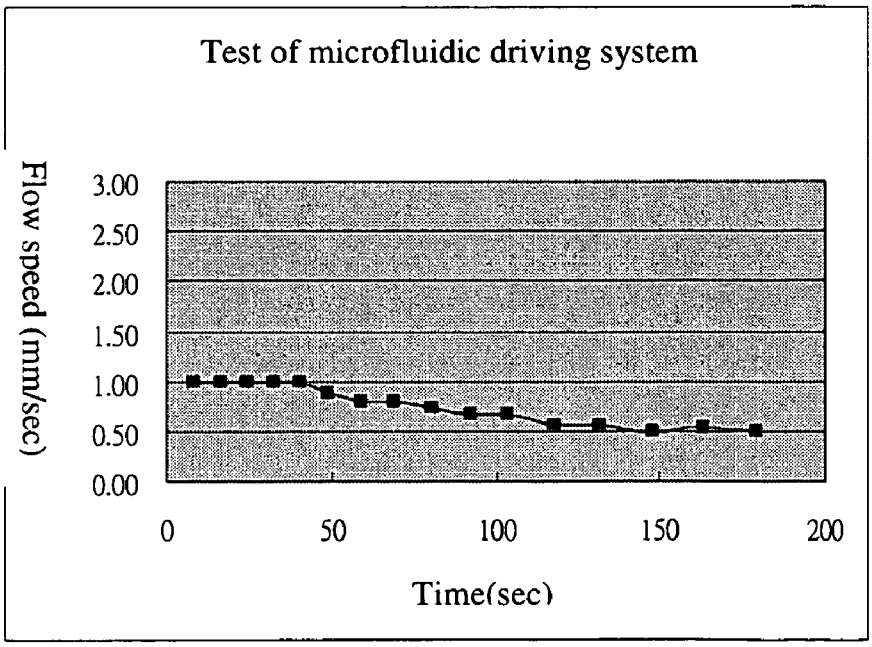
FIG. 9B: the experimental results of time vs. liquid flow speed presented in example 2.

The process of the experiment in this example was the same as that in example 1, except that some design parameters were changed. The driving apparatus was provided with a two-stage flow speed control mechanism using two impedance members. The material of the first impedance member was polyurethane foam. The second impedance member was a membrane filter with 0.2 μm pores. The microfluidic channel was formed by a polydimethylsiloxane (PDMS) structure and a glass substrate. The cross section of the channel was 200 μm by 50 μm, and the fluid was 2 μl whole blood. In the experiment, the distance the fluid segment traveled was recorded and converted into the flow speed of the fluid, as shown in FIGS. 9A and 9B. Within the 3 minutes of observation, the flow speed was between 0.5~1.0 mm/sec, with an average of 0.72 mm/sec.

Example 3

Experiment 3 of a Microfluidic Driving Apparatus

Figure 10:
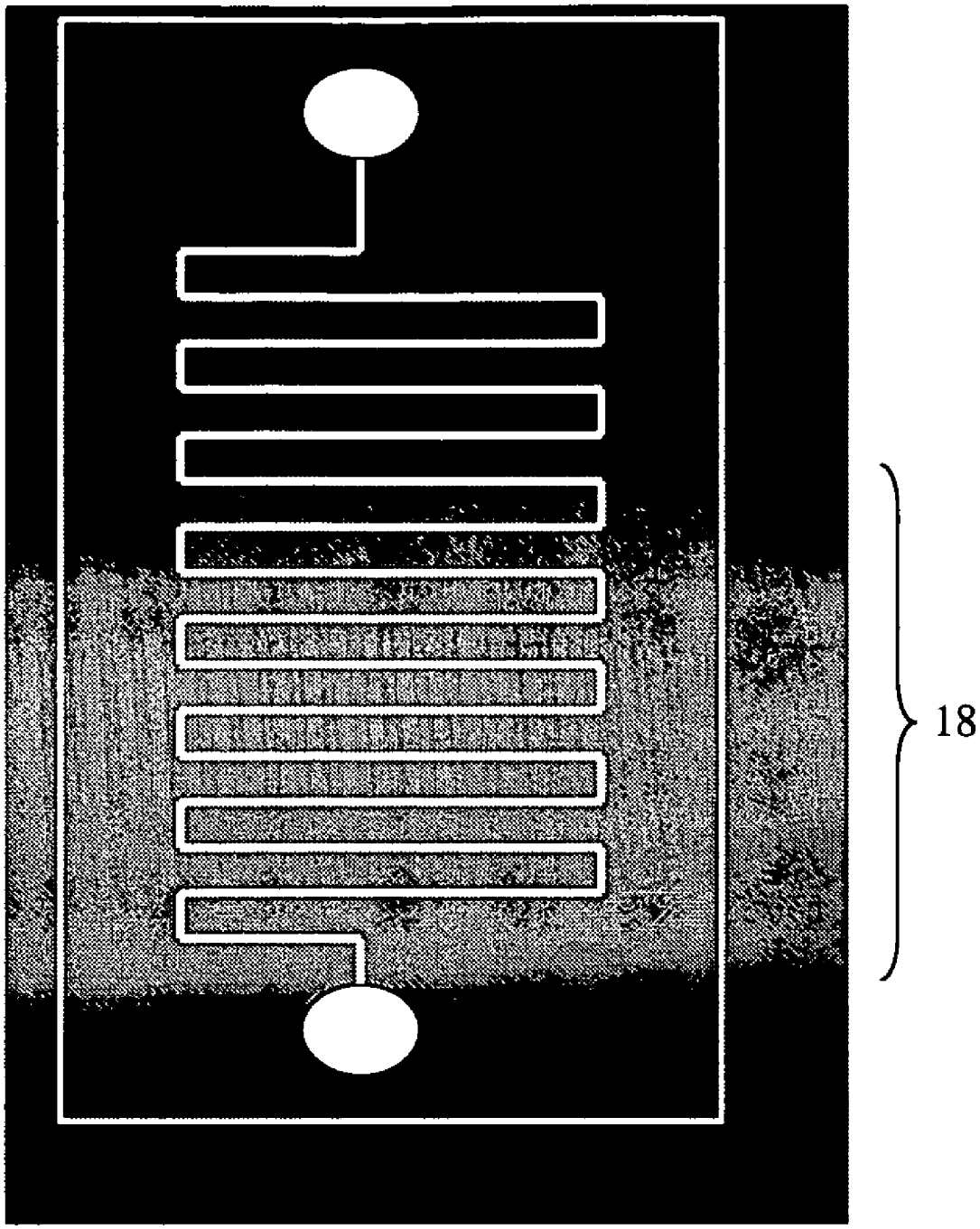
FIG. 10: a microfluidic chip with Teflon stripes on the substrate.
Figure 11A:
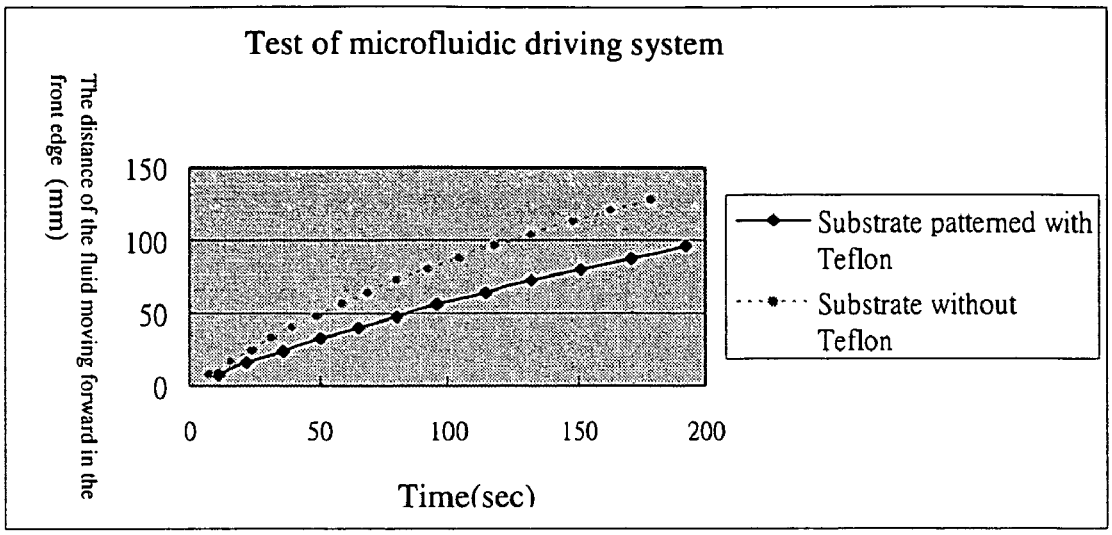
FIG. 11A: the experimental results of time vs. liquid driving distance presented in example 3.
Figure 11B:
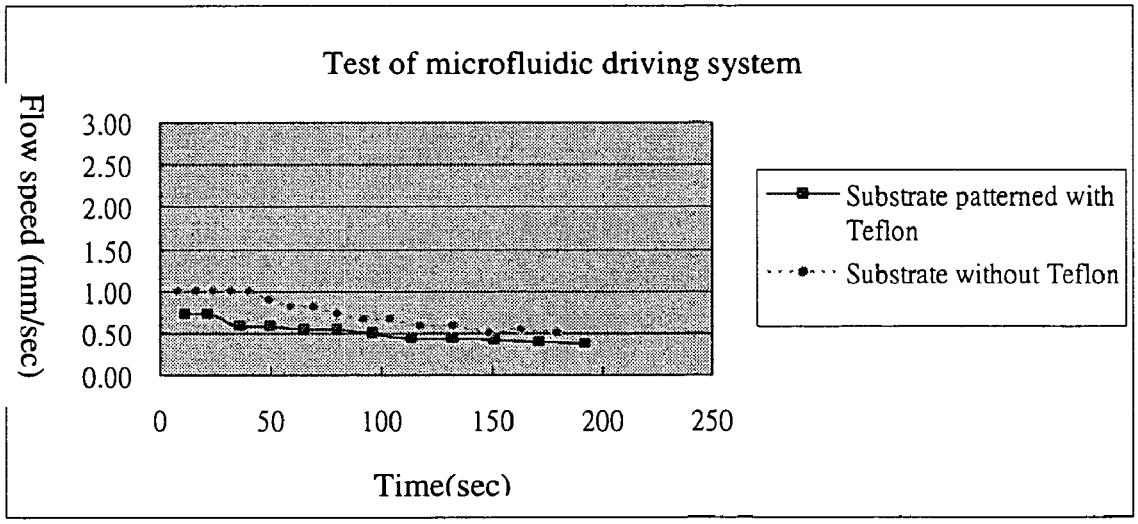
FIG. 11B: the experimental results of time vs. liquid flow speed presented in example 3.

In this experiment the apparatus used, the liquid driven, as well as the structure and the material of the microfluidic chip being tested were the same as those in example 2, except that Teflon stripes were coated on the glass substrate of the microfluidic chip to further reduce the flow speed in the channel. FIG. 10 shows the Teflon coated region 18. In the experiment, the distance the fluid segment traveled was recorded and converted into the flow speed of the fluid, as shown in FIGS. 11A and 11B. On the Teflon-coated region, within the first 3 minutes of observation, the flow speed was between 0.3~0.73 mm/sec, with an average of 0.50 mm/sec, which is slower than in example 2. These results demonstrate that the apparatus of the present invention can be used with other methods, such as special treatments of the chip substrate, to control flow speed.

The apparatus of the present invention has a number of advantages: (1) the design uses simple and inexpensive structural parts; (2) a number of design elements, such as the number of impedance members, the porosity of the impedance members, the number of plunger positioning members, the locations of the plunger positioning members, the internal dimensions of the barrel, or other elements in the multi-stage design, can be varied to meet the requirements of various applications to control flow speed; (3) during chip operation, the apparatus can drive the fluid continuously as needed; (4) the plunger can be operated using suction or expulsion, driving the fluid either forward or backward inside the microfluidic channels; (5) the fluid driving apparatus may be an off-chip device so the choice of the material of the microfluidic chip does not have to compromise requirements of the fluid driving apparatus; (6) the apparatus is easy to operate; it is just a matter of relocating the plunger to the preset position; (7) the inexpensive apparatus, which can be adapted to meet different needs, is disposable.

Although the present invention has been described in its preferred embodiment, it is to be understood that many other possible modifications and variations can be made without departing from the spirit and scope of the invention as hereinafter claimed.

What is claimed is:

1. A microfluidic driving apparatus for driving the fluid flowing in a microfluidic system comprising:

a syringe, which comprises a barrel and a plunger, wherein said barrel is provided with an opening, and said plunger is capable of moving in the barrel;

a plunger positioning member, which is mounted at inside or outside of said barrel and is capable of holding said plunger in a preset position;

a connecting unit for connecting said syringe and said microfluidic system; and a porous impedance member, which is mounted inside said barrel, said microfluidic system or said connecting unit;

wherein a pressure difference between said barrel and said microfluidic system is created to drive said fluid flowing inside said microfluidic system by relocating said plunger in said barrel to said preset position, and said fluid is regulated at a lower speed by using said impedance member.

2. The apparatus of claim 1, wherein said plunger is driven manually, mechanically or electrically to move inside said barrel.

3. The apparatus of claim 1, wherein said plunger moves inside said barrel in a sliding or spiral motion.

4. The apparatus of claim 1, wherein said plunger positioning member is a wedge stopper or a bolt and a nut pattern match.

5. The apparatus of claim 1, wherein said plunger positioning member prevents an unwanted movement of said plunger from preset position by friction resistance.

6. The apparatus of claim 1, wherein said connecting unit is a one-to-one path or one-to-many branches.

7. The apparatus of claim 1, wherein material of said porous member is selected from polyurethane, nitrocellulose, polyethylene, polycarbonate, polytetrafluoroethylene, polypropylene, polyvinylidene fluoride, polyamide, cellulose-esters, polysulfone, polyether-imide, polyetheretherketone or a combination thereof.

8. The apparatus of claim 1, which further comprises a plurality of plunger positioning members for a multi-stage control of the flowing speed of sad microfluidic system.

9. The apparatus of claim 1, which further comprises a plurality of impedance members.

10. A method for driving the fluid flowing in a microfluidic system comprising the following steps:

connecting said microfluidic driving apparatus of claim 1 to a microfluidic system; moving said plunger to a preset position to induce a pressure difference between said barrel and said microfluidic system and to drive the fluid flowing in said microfluidic system; and using said porous impedance member to obstruct the pressure balancing process, allowing said fluid inside said microfluidic system to flow at a regulated speed.

11. A microfluidic driving apparatus for driving the fluid flowing in a microfluidic system comprising:

a syringe, which is connected to said microfluidic system, comprises a barrel and a plunger, said plunger is capable of moving in said barrel; and a porous impedance member, which is mounted inside said barrel, wherein a pressure difference between said barrel and said microfluidic system is created to drive said fluid flowing inside said microfluidic system by moving said plunger in said barrel, and said fluid is regulated at a lower speed by using said impedance member.

12. The apparatus of claim 11, wherein said plunger is driven manually, mechanically or electrically to move inside said barrel.

13. The apparatus of claim 11, wherein said plunger moves inside said barrel in a sliding or spiral motion.

14. The apparatus of claim 11, wherein material of said porous member is selected from polyurethane, nitrocellulose, polyethylene, polycarbonate, polytetrafluoroethylene, polypropylene, polyvinylidene fluoride, polyamide, cellulose-esters, polysulfone, polyether-imide, polyetheretherketone or a combination thereof.

15. The apparatus of claim 11, which further comprises a plurality of impedance members.

16. The apparatus of claim 11, which further comprises a plunger positioning member, which is mounted at inside or outside of said barrel, and is capable of holding said plunger at a preset position.

17. A method for driving the fluid flowing in a microfluidic system comprising the following steps:

connecting said microfluidic driving apparatus of claim 11 to a microfluidic system; moving said plunger to induce a pressure difference between said barrel and said microfluidic system and to drive fluid flowing in said microfluidic system; and using said porous impedance member to obstruct the pressure balancing process, allowing said fluid inside said microfluidic system to flow at a regulated speed.

18. A microfluidic driving apparatus for driving the fluid flowing in a microfluidic system comprising:

a barrel, which is connected to said microfluidic system, wherein said barrel comprises a plunger, said plunger is capable of moving in said barrel along an axis of said barrel; and a porous impedance member, which is mounted inside said barrel, wherein a pressure difference between said barrel and said microfluidic system is created to drive said fluid flowing inside said microfluidic system by moving said plunger in said barrel, and said fluid is regulated at a lower speed by using said impedance member.

19. The apparatus of claim 18, which further comprises a plunger positioning member, which is mounted at inside or outside of said barrel and is capable of holding said plunger at a preset position.

20. The apparatus of claim 18, wherein said plunger is driven manually, mechanically or electrically to move inside said barrel.

21. The apparatus of claim 18, wherein said plunger moves inside said barrel in a sliding or spiral motion.

22. The apparatus of claim 18, wherein material of said porous member is selected from polyurethane, nitrocellulose, polyethylene, polycarbonate, polytetrafluoroethylene, polypropylene, polyvinylidene fluoride, polyamide, cellulose-esters, polysulfone, polyether-imide, polyetheretherketone or a combination thereof.

23. The apparatus of claim 18, which further comprises a plurality of impedance members.

24. A method for driving the fluid flowing in a microfluidic system comprising the following steps:

connecting said microfluidic driving apparatus of claim 18 to a microfluidic system; moving said plunger to induce a pressure difference between said barrel and said microfluidic system and to drive fluid flowing in said microfluidic system; and using said porous impedance member to obstruct the pressure balancing process, allowing said fluid inside said microfluidic system to flow at a regulated speed.

* * * * *